United States Patent [19]

Berry

[11] 4,222,742

[45] Sep. 16, 1980

[54] USE OF ACID SALTS IN DYEING AND/OR PRINTING PROCESSES

[75] Inventor: David Berry, Keyingham, England

[73] Assignee: BP Chemicals Limited, London, England

[21] Appl. No.: 947,756

[22] Filed: Oct. 2, 1978

[30] Foreign Application Priority Data

Oct. 5, 1977 [GB] United Kingdom ..... 41358/77

[51] Int. Cl.[2] ..... D06M 13/20; D06M 13/36; D06M 13/52

[52] U.S. Cl. ..... 8/455; 8/582; 8/574

[58] Field of Search ..... 8/92, 173, 62

[56] References Cited

U.S. PATENT DOCUMENTS 2,018,436 10/1935 Brandt ..... 8/92

FOREIGN PATENT DOCUMENTS 1505388 3/1978 United Kingdom .

*Primary Examiner*—Sandra M. Person

*Attorney, Agent, or Firm*—Brooks, Haidt, Haffner & Delahunty

[57] ABSTRACT

The present invention is a dyeing and/or printing process which employs as an additive a composition comprising one or more cations selected from ammonium, Group I and Group II metals of the Periodic Tables due to Mendeleef, one or more carboxylate anions and water, the ratio of the anion to the cation being in the range of 2:1 and 4:1 on a chemical equivalent basis. The additive can be incorporated into the dyeing and/or printing process at various points in the process, for example at the stages of scouring of the fabric, mordanting, levelling, exhaustion, fixing finishing, water-proofing and milling. They are less corrosive to skin, clothing, plastics and metal and hence are safer to the operative and do not promote deterioration of equipment.

8 Claims, No Drawings

USE OF ACID SALTS IN DYEING AND/OR PRINTING PROCESSES

The present invention relates to the use of acid salts as additives to the dyeing and printing processes for natural and synthetic fibres and fabrics.

In the dyeing industry organic acids are commonly used in the dyeing of wool, nylon, paper, leather and other natural and synthetic fibres with certain acid and chrome dyes. Organic acids such as citric acid and acetic acid are also used as components of printing pastes eg for printing carpets. These acids perform several functions in the dyeing and printing processes such as:

To ensure economic exhaustion (defined as the degree of uptake of the dye by the material dyed) from the aqueous dye bath.

To prevent oxidation of the dyestuff of dichromate in the case of certain chrome dyes by the reducing action of acid such as formic acid.

To achieve rapid dyeing of wool by padding (immersing and then nipping) wool fabric with a concentrated solution of the dye in formic acid.

To achieve the desired pH conditions for the printing of wool and other fabrics.

To achieve adequate levelling (evenness or uniformity of dyeing) with certain dyes, eg mordant acid dye and premetallised dye wherein the acid is used in the form of its neutral salt for the buffering effect to maintain a constant pH.

To fix dyes after the dyeing of nylon (back-tanning).

In all the above applications, the use of free organic acids presents handling problems due to the disagreeable odours of the acid fumes, and the need to wear protective clothing for skin and also results in corrosion of equipment and machinery exposed to such acids and fumes.

It has now been found that by adding a base to these organic acids in aqueous solution in an amount less than the chemical equivalent required for full neutralisation, compositions are formed which when added for example to aqueous dye-bath solutions produce the required pH conditions for adequate levelling and exhaustion of dyes while minimising to a substantial extent the problems relating to odour and corrosivity of the free acids. Some of these compositions have already been described in our British Patent Specification Ser. No. 1,505,388 though not in the context of the dyeing industry. The use of these compositions in the process of the present invention not only minimises the problems relating to odour and corrosivity but also has the surprising advantage of eliminating the need for separate levelling and exhaustion agents.

Accordingly, the present invention is a dyeing and/or printing process which employs as an additive a composition comprising one or more cations selected from ammonium, Group I and Group II metals of the Periodic Tables due to Mendeleef, one or more carboxylate anions and water, the ratio of the anion to the cation being in the range of 2:1 and 4:1 on a chemical equivalent basis.

The carboxylate anion may be derived from a saturated or unsaturated aliphatic carboxylic acid containing between 1 and 8 carbon atoms. The carboxylic acids are preferably selected from one or more of formic acid, acetic acid, propionic acid, n-butyric acid, isobutyric acid, n-valeric acid, 2-methyl butyric acid, succinic acid, laevulinic acid, acrylic acid and methacrylic acid. Carboxylate ions derived from carboxylic acids containing between 1 and 4 carbon atoms are most preferred.

The compositions of the present invention may be liquids, in the form of solutions or solids. In the compositions of the present invention, the cation is preferably selected from ammonium, sodium, potassium, calcium, magnesium and copper. The cation and anions may be present in the composition in the form of one or more complex acid salts. The acid salt is preferably selected from ammonium diformate, sodium diformate, sodium tetraformate, ammonium tetraformate, ammonium diacetate, sodium diacetate, ammonium dipropionate, and sodium dipropionate.

The additive can be incorporated into the dyeing and/or printing process at various points in the process, for example at the stages of scouring of the fabric, mordanting, levelling, exhaustion, fixing finishing, waterproofing and milling. These terms are well known in the art and are defined in standard text books such as for example, "Textile Auxiliaries", by Batty, J W, Pergamon Press (1967) and "The Theory and Practice of Wool Dyeing" by Bird, C L, published by the Society of Dyers and Colourists, Bradford, Yorkshire (1963), 3rd Edition.

Typically, in the dyeing of wool the machine is loaded with wool and water is added together with acids (eg formic acid, acetic acid) and the levelling and pH control agents (eg sodium and ammonium sulphate). The dye bath is held at 40° C. for 5–30 minutes, the dye is added and the bath raised to the boil in 45–60 minutes. The dye bath is held at the boil for 30–60 minutes. At this stage more acid can be added to maintain the pH and to complete dye exhaustion. In such dyeing processes the compositions of the present invention may be added with the initial charge of water to replace either the acid or the levelling agent or both. The concentration used (on a 100% basis) may be in the range of 0.1–10% w/w based on the weight of the fabric being dyed. The compositions may be added as solids containing only the acid salts (eg sodium diacetate) or as liquids eg aqueous solutions of the acid salts containing water in the range of 25%–85% by weight. Additionally, these solutions can be used as a solvent carrier for the dyes. Where the additive is used in the printing of fabrics, it can be added to the printing paste at a concentration of between 0.1 and 10% w/w of the paste depending upon the type of fabric which is being printed.

In dyeing or printing paper, the control of pH is essential and the additives of the present invention not only enable such control but also can be added to the dye used for colouring the pulp or the final product paper.

The additives of the present invention may be used in conjunction with other conventional assistants or agents such as for example wetting agents anti-foams, solubilising agents, thickeners, used in the dyeing or printing process.

The types of dyes used are not limited by the process of the present invention. For example the dyes may be acid, azoic, basic, direct, indirect, dispersed, reactive, mordant, premetallised, solvent, sulphur, vat dyes and optical brighteners.

The principal advantages of using the compositions of the present invention as additives to the dye-bath or printing paste are as follows:

They are less corrosive to skin, clothing, plastics and metal and hence are safer to the operative and do not promote deterioration of equipment. They are less volatile than conventional compositions containing the free organic acids (eg formic acid, acetic acid). They eliminate the need for separate dye levelling and exhaustion agents. Aqueous solutions of the acid salts will act as buffer systems. The acid salts are more soluble in water than the corresponding neutral salt. The acid salts have higher flash points than the corresponding free organic acids.

The present invention is further illustrated with reference to the following Examples.

EXAMPLE 1

Dyeings of wool were carried out in a Jeffries Dyemaster, using a liquor ratio of 60:1. The dyeings were raised to the boil at 1° C. per minute and boiled for a further 60 minutes.

The following recipe based on 2:1 premetallised dye was used:

| | |
|---|---|
| Neutrichrome Yellow S-JRLL Double | 0.35 |
| Neutrichrome Brown S-2RLL Double | 1.10 |
| Neutrichrome Grey S-BJL Double | 0.01 |
| Unisol BT | 1.00 |

Sodium diacetate (2.5% w/w based on the weight of wool) was used as a combined levelling and exhaustion agent.

In a comparative test (not according to the invention) a conventional mixture of ammonium sulphate (4.0% w/w based on the same wool) and acetic acid (1.0% w/w based on the same wool) was also used as a combined levelling and exhaustion agent. The results of these two experiments are shown below in Table I.

TABLE I

| | % Dye Exhaustion | |
|---|---|---|
| | Exhaustion Levels | |
| Time | Ammonium Sulphate 4.0% + Acetic Acid 1.0%* | Sodium Diacetate |
| 10 min at 40° C. | 5.9 | 8.3 |
| 50° C. | 9.2 | 11.3 |
| 60° C. | 12.0 | 15.2 |
| 70° C. | 21.2 | 22.0 |
| 80° C. | 40.5 | 39.7 |
| 90° C. | 56.1 | 55.0 |
| 100° C. | 73.4 | 71.5 |
| 15 min Boil | 91.7 | 91.5 |
| 30 min Boil | 93.9 | 93.8 |
| 45 min Boil | 95.3 | 95.7 |
| 60 min Boil | 96.0 | 96.4 |

*Comparative Test

The above results indicate that the degree of levelling/exhaustion obtained by addition of 2.5% sodium diacetate closely matched that obtained using a conventional agent.

Measurements of pH's of the dye-bath solutions after 60 minutes boil also indicated that the dye bath containing sodium diacetate increased by only 0.08 units whereas that of the bath containing ammonium sulphate/acetic acid mixture increased by 0.23 units. This also shows the good buffering capacity of the compositions of the present invention.

No difference in the colour fastness was noticed between the wool dyed by the two compositions.

EXAMPLE 2

In this example the effectiveness of sodium tetraformate as a carpet printing fixing agent was compared with a conventionally used agent, citric acid.

A tufted wool carpet on a woven polypropylene backing was printed with a four (4) column colour design using nylon screens. The print pastes were made up in 3 kg batches. For each batch an aqueous solution of the dye was mixed with 1.5 kg of a stock aqueous solution of a thickener and auxiliary chemicals. This stock solution had the following composition:

| | |
|---|---|
| Guaranate AP6 Thickener | 30 g/liter |
| Matexil PAS Dye (Solubilising Agent) | 10 g/liter |
| Silcolapse 5006 Anti-foam | 10 g/liter |
| Acid producing additive (either citric acid or 65% aq. sodium tetraformate) | 10 g/liter |

The following print paste formulations were produced:

| | |
|---|---|
| 1. Green | |
| Carbolan Yellow 4G Dye | 15 g |
| Erionyl Green 4G Dye | 3 g |
| Water | 1482 g |
| Stock solution of thickener and auxiliary chemicals | 1500 g |
| Total | 3000 g |
| 2. Yellow | |
| Procilan Yellow B8G Dye | 15 g |
| Water | 1485 g |
| Stock solution of thickener and auxiliary chemicals | 1500 g |
| Total | 3000 g |
| 3. Red | |
| Eriosin Orange G Dye | 12 g |
| Erio Rubine 3GS Dye | 1.5 g |
| Water | 1486.5 g |
| Stock solution of thickener and auxiliary chemicals | 1500 g |
| Total | 3000 g |
| 4. Blue | |
| Coomassie Blue SE Dye | 22.5 g |
| Water | 1477.5 g |
| Stock solution of thickener and auxiliary chemicals | 1500 g |
| Total | 3000 g |

Hence, each paste contained 5 g/liter (0.5% w/w) of either citric acid or 65% aqueous sodium tetraformate. A section of carpet was printed using the citric acid containing pastes, and another section printed under exactly the same conditions using the sodium tetraformate containing pastes. The carpet was steamed for 12 minutes at 98°-100° C., and put in a "side-paddle washer" for 3 minutes at 40° C., followed by a 2 minute cold rinse. Colour penetration was good using either acidulent, and there was no detectable difference in performance. Both sections of carpet showed identically good results on colour fastness and resistance to colour loss by rubbing. No smell of formic acid was detected during steaming of the carpet printed with the sodium tetraformate containing pastes. Citric acid is recommended in the United Kingdom as a non-volatile acidulent in preference to formic or acetic acid which can volatilise during steaming. This experiment clearly illustrates that sodium tetraformate could equally be used as an effective, non-volatile, and safer to handle alternative to formic acid. Additionally present UK cost estimates indicate that sodium tetraformate would be more cost effective than citric acid.

EXAMPLE 3

The following example illustrates the lack of any degradative effect of the acid salts on fabrics to be printed or dyed. A number of acid salts were applied individually to 100% cotton fabric by two distinct methods.

(1) By long liquor application—cotton samples were treated for 1 hour and 130° C. at a liquor ratio of 30:1 (40 g sample in 1200 g of liquor) in a solution containing 5 g/liter (100% basis) of acid salt.

(2) Application by padding—A solution containing 10 g/liter acid salt was applied by pad mangle to a pick-up on the fabric of 65% acid salt, and the fabric then dried at 120° C. for 2 minutes.

The samples, after both methods of application, were then rinsed, hydroextracted and air dried overnight.

When dry, the samples were subjected to tensile strength measurements, in triplicate, in the warp direction only. The results shown in Table 2 were achieved.

TABLE 2

| Sample | Breaking Load - Kg/50 mm |
|---|---|
| Control (no treatment) | 33.4 |
| Sodium diacetate by long liquor | 32.4 |
| Sodium diacetate by padding | 32.4 |
| Ammonium tetraformate by long liquor | 33.6 |
| Ammonium tetraformate by padding | 32.5 |

The results indicated that, under the conditions of application, the acid salts had very little, if any, degradation effect on the cotton fabric. Variation within the results was considered to be of the same order as that expected from repeat measurements of one sample.

I claim:

1. A dyeing and/or printing process which employs as an additive a liquid or solid composition comprising one or more cations selected from ammonium, Group I and Group II metals of the Periodic Tables due to Mendeleef, one or more carboxylate anions and water, the ratio of the anion to the cation being in the range of 2:1 and 4:1 on a chemical equivalent basis.

2. A process according to claim 1 wherein the carboxylate anion is derived from a saturated or unsaturated aliphatic carboxylic acid containing between 1 and 8 carbon atoms.

3. A process according to claim 2 wherein the carboxylic acids are selected from one or more of formic acid, acetic acid, propionic acid, n-butyric acid, isobutyric acid, n-valeric acid, 2-methyl butyric acid, succinic acid, laevulinic acid, acrylic acid and methacrylic acid.

4. A process according to claim 1 wherein the cation is selected from ammonium, sodium, potassium, calcium, magnesium and copper.

5. A process according to claim 1 wherein the cations and anions are present in the liquid composition in the form of one or more complex acid salts.

6. A process according to claim 5 wherein the acid salt is selected from ammonium diformate, sodium diformate, ammonium tetraformate, sodium tetraformate, ammonium diacetate, sodium diacetate, ammonium dipropionate, and sodium dipropionate.

7. A process according to claim 1 wherein the additive at a concentration in the range of 0.1 to 10% w/w based on the weight of the fabric being dyed or printed is incorporated into the dyeing and/or printing process during one or more of the stages of scouring of the fabric, mordanting, levelling, exhaustion, fixing, finishing, water-proofing and milling.

8. A process according to claim 1 wherein the additive at a concentration in the range of 0.1 to 10% w/w based on the weight of the fabric being dyed or printed is added to the printing paste.

* * * * *